US011692733B2

(12) United States Patent
Peng

(10) Patent No.: US 11,692,733 B2
(45) Date of Patent: Jul. 4, 2023

(54) AIR DEFLECTION ASSEMBLY FOR AIR CONDITIONER

(71) Applicant: GD MIDEA AIR-CONDITIONING EQUIPMENT CO., LTD., Guangdong (CN)

(72) Inventor: Jielin Peng, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 574 days.

(21) Appl. No.: 16/812,924

(22) Filed: Mar. 9, 2020

(65) Prior Publication Data

US 2020/0217554 A1 Jul. 9, 2020

Related U.S. Application Data

(63) Continuation of application No. PCT/CN2018/084925, filed on Apr. 27, 2018.

(30) Foreign Application Priority Data

Sep. 12, 2017 (CN) ..... 201721169631.1

(51) Int. Cl.
*F24F 13/06* (2006.01)
*F24F 1/028* (2019.01)
(Continued)

(52) U.S. Cl.
CPC ..... *F24F 13/06* (2013.01); *F24F 1/028* (2019.02); *F24F 1/029* (2019.02); *F24F 13/065* (2013.01); *F24F 13/10* (2013.01)

(58) Field of Classification Search
CPC .. F24F 13/06; F24F 13/10; F24F 13/14; F24F 13/1413; F24F 1/0007; F24F 1/0011
See application file for complete search history.

(56) References Cited

U.S. PATENT DOCUMENTS 4,570,533 A * 2/1986 Sugawara ..... F24F 13/072 239/509
6,916,240 B1 * 7/2005 Morton ..... F24F 13/065 454/286

(Continued)

FOREIGN PATENT DOCUMENTS

CN 2 446 431 Y 9/2001
CN 2446431 Y 9/2001

(Continued)

OTHER PUBLICATIONS

Notice of Reasons for Refusal dated Mar. 30, 2021 received in Japanese Patent Application No. JP 2019-542080 together with an English language translation.

(Continued)

*Primary Examiner* — Lionel Nouketcha
(74) *Attorney, Agent, or Firm* — Scully, Scott, Murphy & Presser, P.C.

(57) ABSTRACT

An air conditioner is provided. A main body of the air conditioner is provided with an air outlet facing a front lower side of the main body. An upper passage is arranged above the air outlet and in communication with the air outlet, and is adapted to supply air forwardly. An upper air deflection assembly is used to direct air to flow out of a terminus of the upper passage. The upper air deflection assembly has an upper air diffusing plate. A front air deflection assembly is used to direct air to flow out of a terminus of the air outlet.

13 Claims, 7 Drawing Sheets

(51) Int. Cl.

| | |
|---|---|
| ***F24F 1/029*** | (2019.01) |
| ***F24F 13/10*** | (2006.01) |
| ***F24F 13/065*** | (2006.01) |

(56) References Cited

U.S. PATENT DOCUMENTS

| | | | | |
|---|---|---|---|---|
| 2012/0031134 | A1* | 2/2012 | Shirota | F24F 1/0029 62/288 |
| 2014/0273805 | A1* | 9/2014 | Yasutomi | F24F 1/0011 454/284 |

FOREIGN PATENT DOCUMENTS

| | | | | |
|---|---|---|---|---|
| CN | 1 580 661 | A | 2/2005 | |
| CN | 1580661 | A | 2/2005 | |
| CN | 201 106 913 | Y | 8/2008 | |
| CN | 201106913 | Y | 8/2008 | |
| CN | 103335388 | A | 10/2013 | |
| CN | 104214835 | A | 12/2014 | |
| CN | 104 422 094 | A | 3/2015 | |
| CN | 104422094 | A | 3/2015 | |
| CN | 104697051 | A | 6/2015 | |
| CN | 204987237 | U | 1/2016 | |
| CN | 105 485 765 | A | 4/2016 | |
| CN | 105485765 | A | 4/2016 | |
| CN | 105 928 074 | A | 9/2016 | |
| CN | 105928074 | A | 9/2016 | |
| CN | 106 403 030 | A | 2/2017 | |
| CN | 106403030 | A | 2/2017 | |
| CN | 206 018 823 | U | 3/2017 | |
| CN | 206018823 | U | 3/2017 | |
| CN | 106642616 | A | 5/2017 | |
| CN | 106895485 | A | 6/2017 | |
| CN | 206247479 | U | 6/2017 | |
| CN | 106949557 | A | 7/2017 | |
| CN | 107 062 398 | A | 8/2017 | |
| CN | 107 084 427 | A | 8/2017 | |
| CN | 107062398 | A | 8/2017 | |
| CN | 107084427 | A | 8/2017 | |
| CN | 107726449 | A | 2/2018 | |
| CN | 107726584 | A | 2/2018 | |
| EP | 1553358 | A1 | 7/2005 | |
| EP | 1707893 | A1 * | 10/2006 | F24F 1/0011 |
| EP | 3 382 287 | A1 | 10/2018 | |
| JP | S60-171030 | A | 9/1985 | |
| JP | S61-272537 | A | 12/1986 | |
| JP | H05-141680 | A | 6/1993 | |
| JP | H09-196456 | A | 7/1997 | |
| JP | H10-122589 | A | 5/1998 | |
| JP | H10-148352 | A | 6/1998 | |
| JP | H11-257727 | A | 9/1999 | |
| JP | H11-311446 | A | 11/1999 | |
| JP | 2000-146276 | A | 5/2000 | |
| JP | 2000-220878 | A | 8/2000 | |
| JP | 2002-130718 | A | 5/2002 | |
| JP | 2003-194362 | A | 7/2003 | |
| JP | 2003-240313 | A | 8/2003 | |
| JP | 2004-293819 | A | 10/2004 | |
| JP | 2007-205711 | A | 8/2007 | |
| JP | 2008-190779 | A | 8/2008 | |
| JP | 4548979 | B2 | 9/2010 | |
| JP | 2011-179739 | A | 9/2011 | |
| KR | 20030083059 | A | 10/2003 | |
| KR | 10-2005-0117666 | A | 12/2005 | |
| KR | 10-0748172 | B1 | 8/2007 | |
| KR | 101287527 | B1 | 7/2013 | |
| KR | 10-2017-0051095 | A | 5/2017 | |
| WO | 2016/197747 | A1 | 12/2016 | |
| WO | WO 2016/197747 | A1 | 12/2016 | |
| WO | 2017/024637 | A1 | 2/2017 | |
| WO | WO 2017/024637 | A1 | 2/2017 | |

OTHER PUBLICATIONS

Notice of Reasons for Refusal dated Apr. 6, 2021 received in Japanese Patent Application No. JP 2020-511479 together with an English language translation.

Examination Report No. 2 dated Mar. 18, 2021 received in Australian Patent Application No. AU 2018333383.

Notification of Reason for Refusal dated Feb. 19, 2021 received in Korean Patent Application No. KR 10-2020-7004518 together with an English language translation.

Notification of Reason for Refusal dated Feb. 19, 2021 received in Korean Patent Application No. KR 10-2020-7004815 together with an English language translation.

Office Action dated Mar. 11, 2022 received in European Patent Application No. EP 18 856 323.3.

Office Action dated Mar. 23, 2022 received in European Patent Application No. EP 18 855 423.2.

Notification of Reason for Refusal dated Aug. 27, 2021 received in Korean Patent Application No. KR 10-2020-7004815 together with an English language translation.

Notice of Reasons for Refusal dated Sep. 7, 2021 received in Japanese Patent Application No. JP 2020-511479 together with an English language translation.

Notice of Review dated Sep. 24, 2021 received in Chinese Patent Application No. CN 201710819422 5 together with an English language translation.

Notice of Reasons for Refusal dated Sep. 1, 2020 received in Japanese Patent Application No. JP 2019-542080 together with an English language translation.

Examination Report No. 1 dated Dec. 3, 2020 received in Australian Patent Application No. AU 2018331011.

Examination Report No. 1 dated Nov. 2, 2020 received in Australian Patent Application No. AU 2018333383.

International Search Report dated Jul. 12, 2018 issued in PCT/CN2018/084925.

Search Report dated Jul. 23, 2020 received in European Patent Application No. EP 18855423.2.

Request for the Submission of an Opinion dated May 24, 2022 received in Korean Patent Application No. KR 10-2020-7004815.

Extended European Search Report dated May 25, 2020 received in European Patent Application No. EP 18856323.3.

* cited by examiner

AIR DEFLECTION ASSEMBLY FOR AIR CONDITIONER

FIELD

The present disclosure relates to the field of air conditioning technology, and more particularly to an air conditioner.

BACKGROUND

With more occurrence of extreme weather, air conditioners have gradually entered numerous families. Despite of offering a better environment, air conditioners may cause discomfort if the cold wind directly blows toward people while the human body and environment are at low temperature. The discomfort becomes more salient for the senior people.

SUMMARY

According to an aspect of the present disclosure, an air conditioner is provided, which offers good air guiding performance and comfortable experience.

The air conditioner according to the present disclosure includes a main body provided with an air outlet facing a front lower side, wherein an upper passage in communication with the air outlet is arranged above the air outlet and is adapted to supply air forwards; an upper air deflection assembly used to direct air to flow out of a terminus of the upper passage, and comprising an upper air diffusing plate used to open and close the upper passage; and a front air deflection assembly used to direct air to flow out of a terminus of the air outlet, the front air deflection assembly comprising a first air deflector located at an opening of the air outlet and adapted to open and close the air outlet, and the front air deflection assembly having an air diffusing structure.

The air conditioner according to the present disclosure offers good air guiding performance and comfortable experience.

In addition, the air conditioner according to the present disclosure has the following additional technological features.

In an embodiment of the present disclosure, the upper air diffusing plate is arranged at the terminus of the upper passage, and an upper end or a lower end of the upper air diffusing plate serves as a rotating end.

In an embodiment of the present disclosure, the upper air diffusing plate has an air diffusing structure.

In an embodiment of the present disclosure, the upper air deflection assembly also comprises an upper spoiler movable between a position opening the upper passage and a position closing the upper passage.

In an embodiment of the present disclosure, when the upper spoiler opens the upper passage, the upper spoiler extends toward an interior of the air outlet and is adapted to direct at least part of airflow from the air outlet to the upper passage.

In an embodiment of the present disclosure, when the upper spoiler is open, the upper spoiler is located downstream of the upper passage in an air outflow direction of the air outlet and is substantially perpendicular to the air outflow direction of the air outlet.

In an embodiment of the present disclosure, the upper spoiler is rotatably mounted at an entry of the upper passage.

In an embodiment of the present disclosure, the upper spoiler is provided with an air diffusing structure.

In an embodiment of the present disclosure, a thermal insulation member for the upper passage is provided adjacent to a side wall of the upper passage.

In an embodiment of the present disclosure, when the first air deflector closes the air outlet, an outer surface of the first air deflector is substantially flush with an outer surface of the main body.

In an embodiment of the present disclosure, the first air deflector is connected with the main body and is flappable upwardly and downwardly. When the first air deflector opens the air outlet, the first air deflector is adapted to: be completely offset from a front side of an air outflow direction of the air outlet; be completely offset from a front side of an air outflow direction of an outlet passage; or have at least a part located in front of the air outflow direction of the air outlet and direct air upwardly or downwardly.

In an embodiment of the present disclosure, the front air deflection assembly also includes a second air deflector in the air outlet. The second air deflector has at least one of a first position extending along an air outflow direction of the air outlet, a second position inclined upwardly along the air outflow direction of the air outlet, a third position inclined downwards along the air outflow direction of the air outlet, and a fourth position substantially perpendicular to the air outflow direction of the air outlet.

In an embodiment of the present disclosure, the second air deflector is provided with an air diffusing structure.

Figure 1:
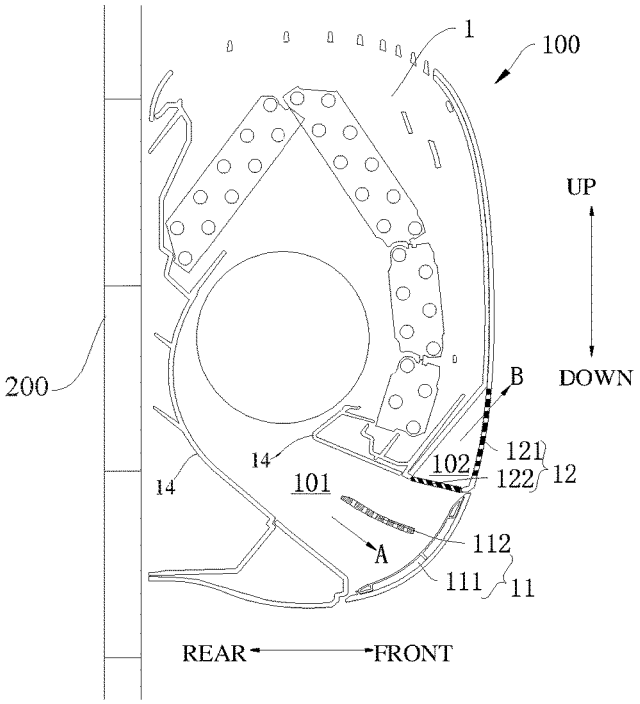
FIGS. 1-7 are schematic views of an air conditioner at different operational states thereof, in accordance with an exemplary embodiment of the present disclosure.

REFERENCE NUMERALS air conditioner 100, main body 1, air outlet 101, front air deflection assembly 11, first air deflector 111, second air deflector 112, upper passage 102, upper air deflection assembly 12, upper air diffusing plate 121, upper spoiler 122, lower passage 103, lower air deflection assembly 13, lower air diffusing plate 131, lower spoiler 132, thermal insulation member 14, air outflow direction A of air outlet 101, air outflow direction B of upper passage, air outflow direction C of lower passage.

DETAILED DESCRIPTION OF EMBODIMENTS

The embodiments of the present disclosure are described in detail below, and examples of the embodiments are shown in the attached drawings, where throughout which the identical or similar labels are used to denote the identical or similar elements or elements having identical or similar functions. The embodiments described below by reference to the attached drawings are illustrative and are used only to interpret the present disclosure but should not be construed as restrictions on the present disclosure.

An air conditioner 100 based on the embodiments of the present disclosure is described below with reference to FIGS. 1-22. The air conditioner 100 can be portable air conditioner and indoor unit of wall-mounted air conditioner. It comprises a main body 1, to which an air outlet 101 facing forwardly and/or downwardly is provided to supply flowing air forwardly and/or downwardly. The air passage is arranged above, below, or both above and below the air outlet 101. The main body 1 has a rear (or posterior) side, through which the air conditioner 100 can be mounted to an outside support 200, which can be for example a wall of a household. The main body 1 also has a front (or anterior) side, which is distanced from the outside support but opposite to the rear (or posterior) side of the main body.

With the passages above and below the air outlet 101 in the present disclosure, air can be directed to other places, so as to avoid directly blowing toward people.

A front air deflection assembly 11 is mounted to the air conditioner 100, which can direct air to flow from the air outlet 101.

In addition, a heat insulating member 14 is arranged at the passage above and/or below the air outlet 101, which can preserve heat for the passage, so as to prevent condensation from being produced during the flow of cold air through the corresponding passage.

In addition, the heat insulating member 14 can be mounted outside or inside the passage, or embedded in the passage wall.

In some embodiments of the present disclosure, as shown in FIGS. 1-22, the front air deflection assembly 11 comprises a first air deflector 111, which is located at the opening of the air outlet 101 and used to open and close the air outlet 101. For instance, when the first air deflector 111 closes the air outlet 101, air conditioner 100 can be powered off; alternatively, when the first air deflector 111 closes the air outlet 101, air conditioner 100 can be powered on, and in this case, since the air passage is arranged above, below, or both above and below the air outlet 101, air can flow out through the passage above and/or below the air outlet 101, so as to achieve air supply in different directions.

Further, an air diffusing structure can be provided to the first air deflector 111, used for ventilation and airflow diffusion.

The air diffusing structure in the present disclosure comprises, but is not limited to, micropores, air bubbles, blades, and shutters. The air diffusing structure can be anyone of micropores, air bubbles, blades, shutters, or any combination thereof. Air bubble protrudes along the outlet direction and is directed toward the microchannel which forms the specified angle with the outlet direction. A plurality of vents on the air diffusing structure can disperse wind forwardly, backwardly, upwardly, and downwardly.

Figure 8:
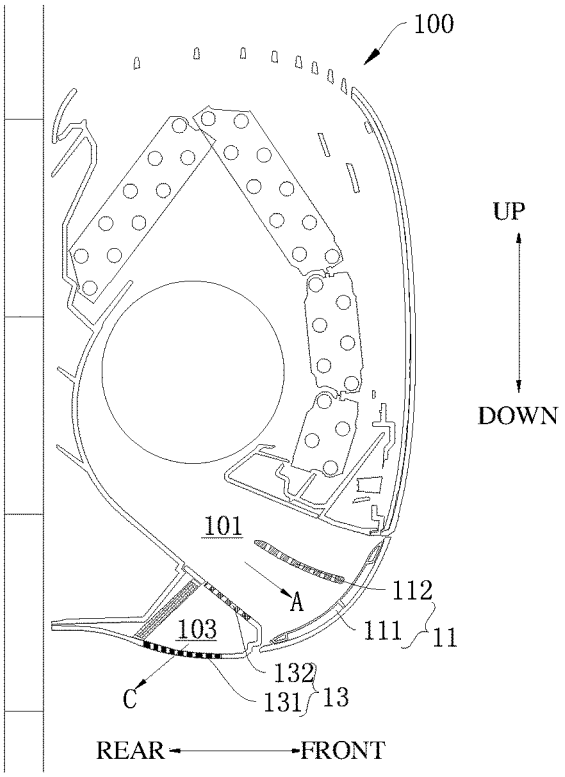
FIGS. 8-12 are schematic views of an air conditioner at different operational states thereof, in accordance with another exemplary embodiment of the present disclosure.
Figure 9:
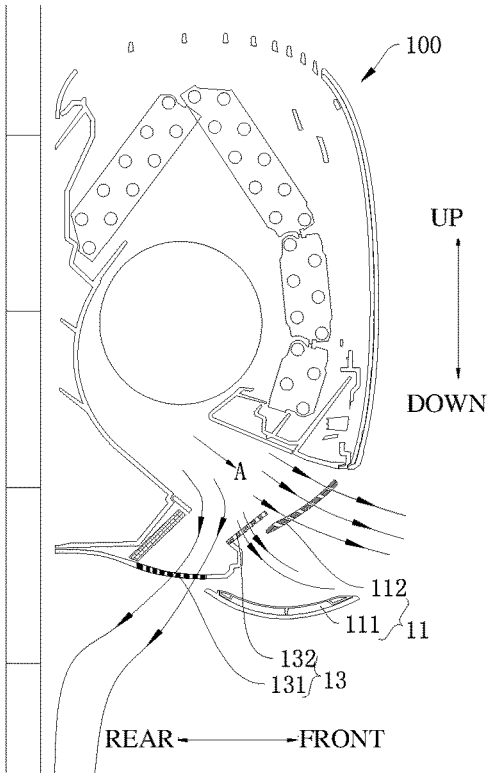
Figure 10:
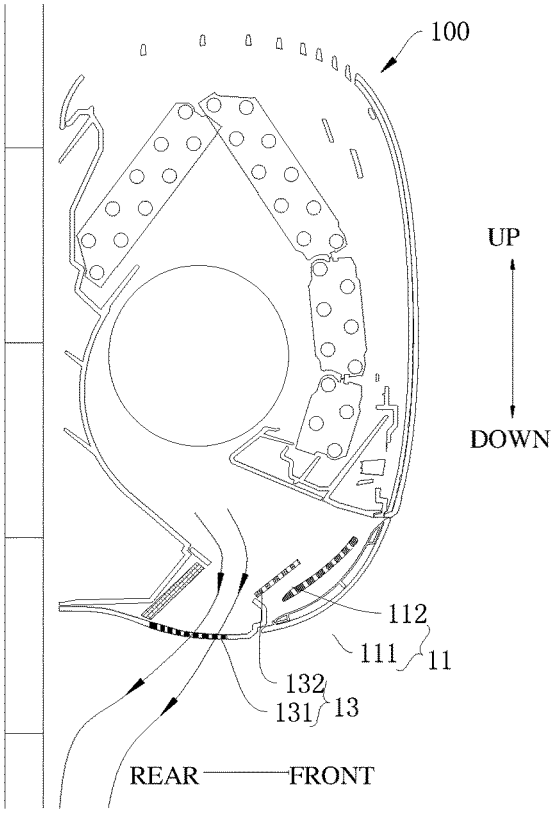
Figure 15:
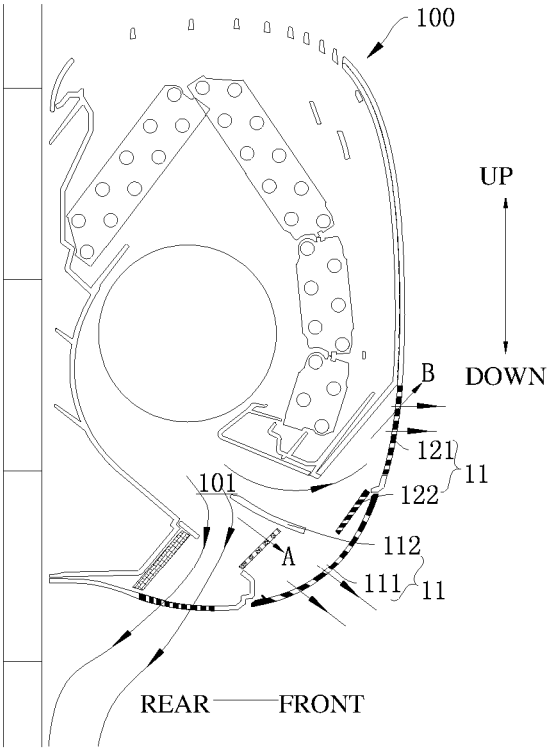
Figure 16:
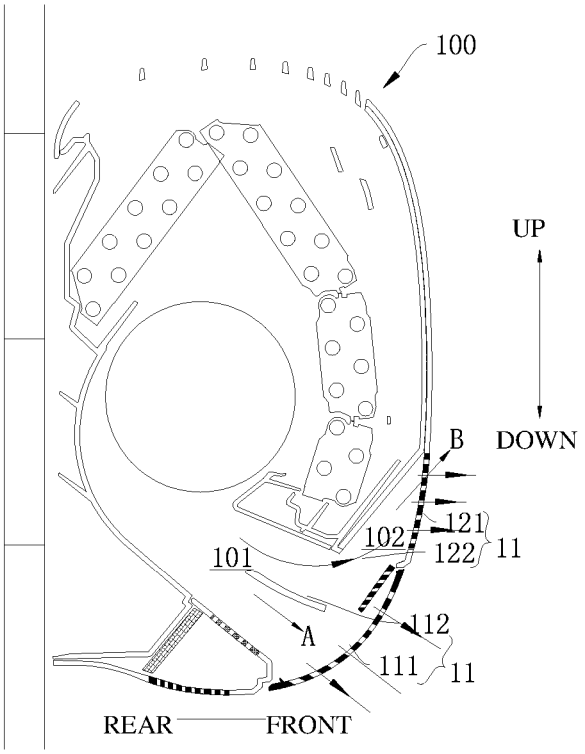
Figure 17:
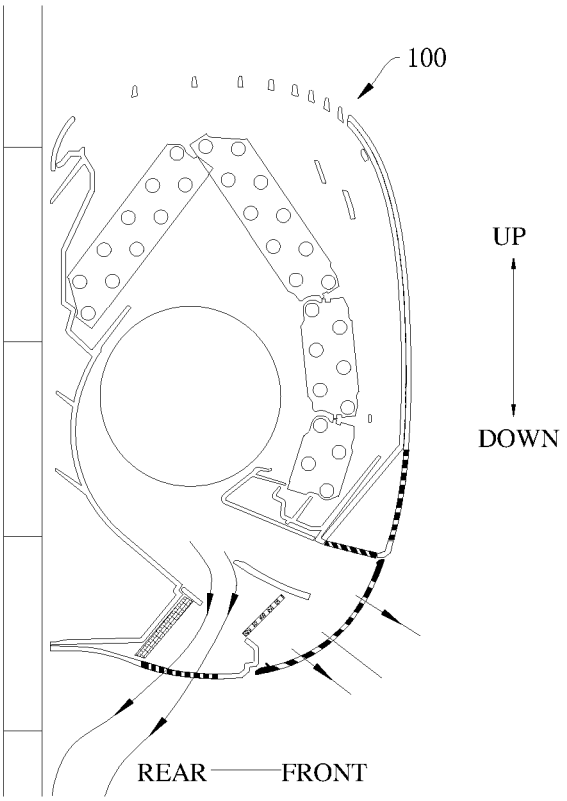
Figure 18:
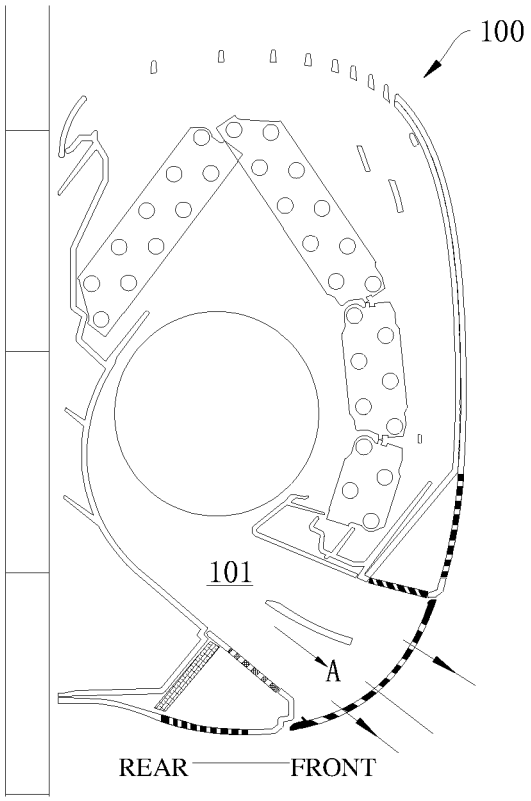
Figure 19:
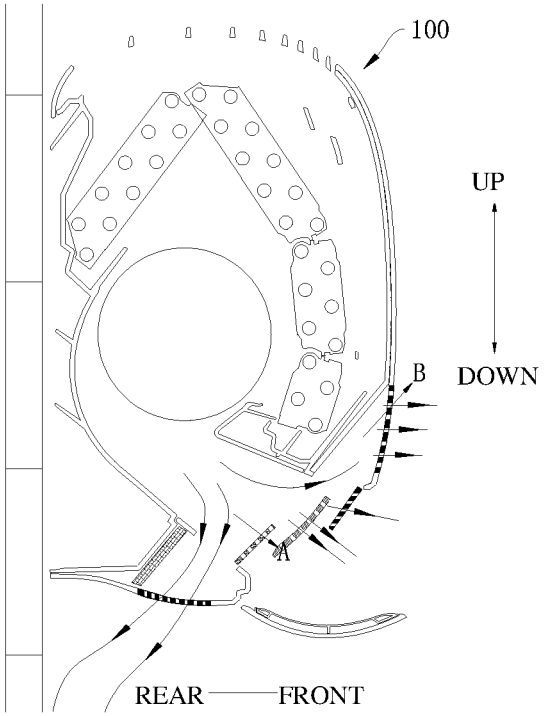
Figure 20:
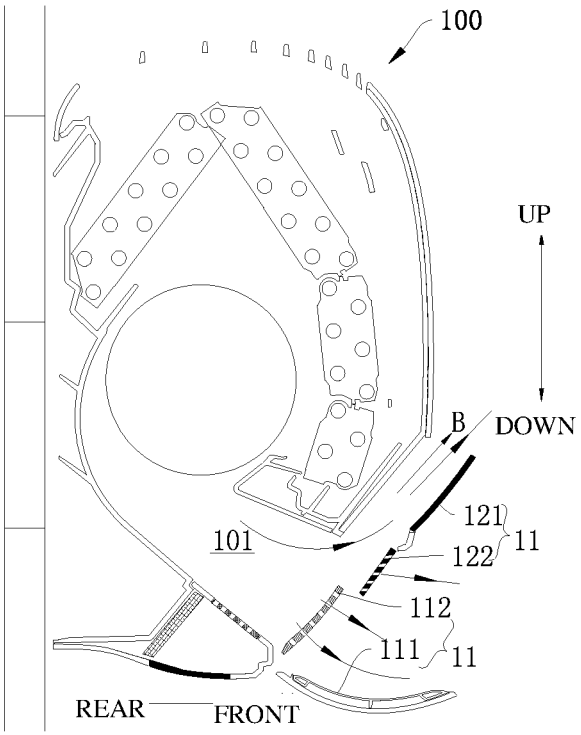
Figure 21:
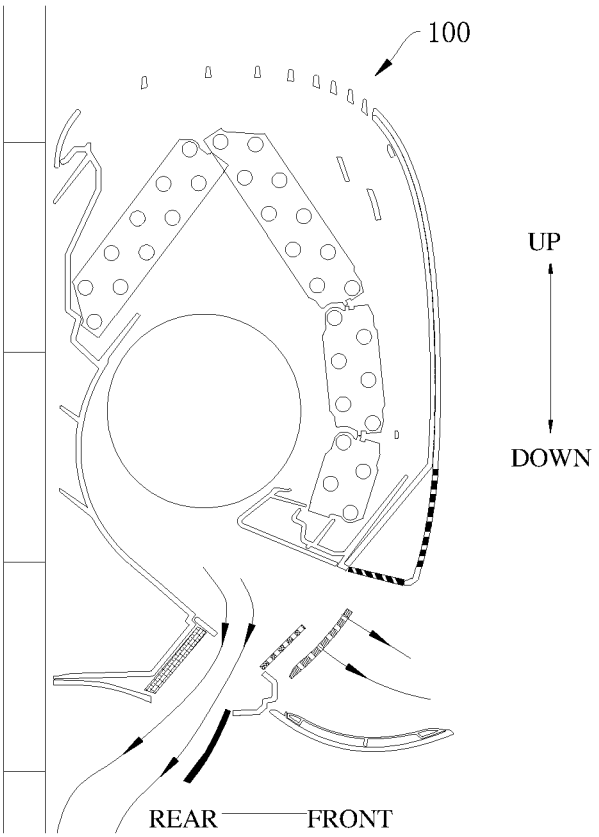
Figure 22:
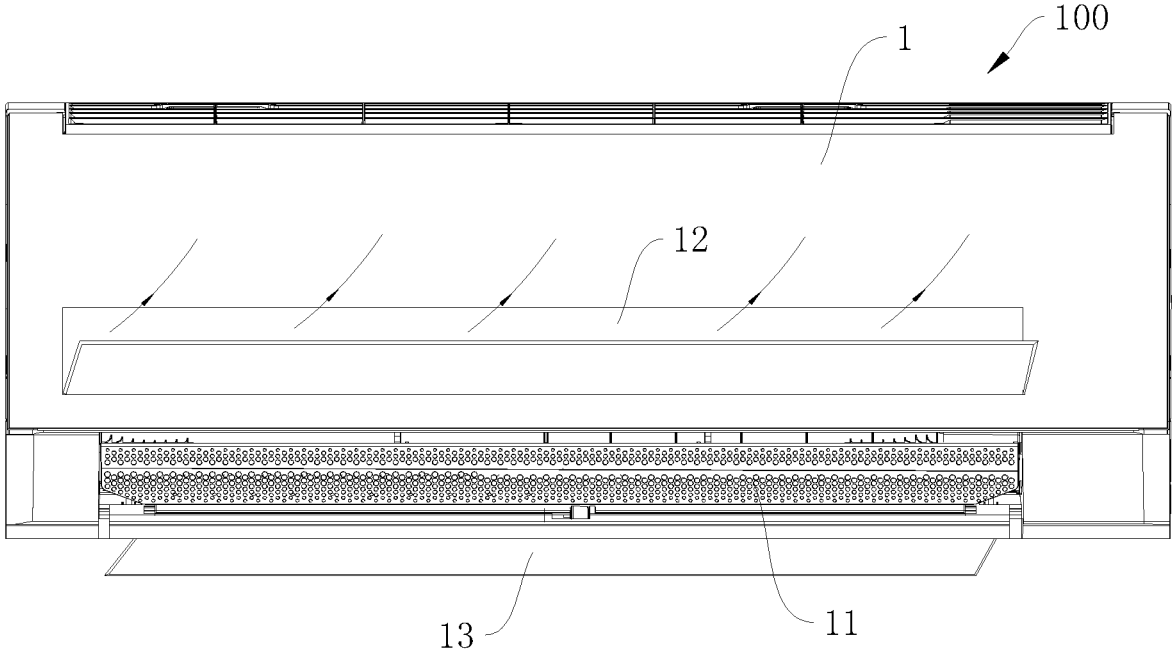

For example, as shown in FIGS. 1, 8 and 15, when the first air deflector 111 closes the air outlet 101, the outside surface of the first air deflector 111 can be substantially aligned with a front external contour or surface of the main body 1, such that the outside surface of the first air deflector 111 is substantially continuous with the front external contour of the main body. It improves the appearance of the air conditioner 100, and facilitates the first air deflector 111 to close the air outlet 101 completely.

Further, the first air deflector 111 can rotate or pivot upwardly and/or downwardly, while being connected to the main body 1, such that, when the first air deflector 111 exposes the air outlet 101, the first air deflector 111 and the front external contour in the air outflow direction of the air outlet 101 are completely or at least partially staggered with respect to each other. Therefore the first air deflector 111 does not prevent the airflow from the air outlet 101.

In addition, the first air deflector 111 can also be set as the following: when the first air deflector 111 is open, at least a part of the first air deflector 111 is located in front of the air outflow direction of the air outlet 101, and directs the wind upwardly or downwardly. In this case, the wind can be directed upwardly or downwardly through the first air deflector 111.

Within the scope of the disclosure, the first air deflector 111 can assume other suitable forms and profiles when the first air deflector 111 is open, e.g. the passage above or below the air outlet 101 can be selectively obstructed or non-obstructed.

In addition, the multiple positions or states of the first air deflector 111 are not incompatible with each other. In other words, the first air deflector 111 of the air conditioner 100 can be set to anyone of the multiple positions or states when it is open, which can be achieved for example by adjusting the opening angle of the first air deflector 111.

Further, the front air deflection assembly 11 also comprises a second air deflector 112 in the air outlet 101, which includes at least a first position, a second position, a third position, and a fourth position.

When the second air deflector 112 is at the first position, it extends along the air outflow direction of the air outlet 101; when the second air deflector 112 is at the second position, it inclines upwardly along the air outflow direction of the air outlet 101; when the second air deflector 112 is at the third position, it inclines downwardly along the air outflow direction of the air outlet 101; and when the second air deflector 112 is at the fourth position, it is substantially perpendicular to the direction of the air outlet 101.

In some embodiments of the present disclosure, the second air deflector 112 can be set to assume anyone of the first position, the second position, the third position, and the fourth position. The second air deflector 112 can direct airflow in different directions at the first position, the second position, the third position, and the fourth position.

The second air deflector 112 extends along the air outflow direction of the air outlet 101 at the first position thereof.

For example, for the air conditioner 100 with passage above or below the air outlet 101, the second air deflector 112 has an air diffusing effect.

When the passages are arranged above and below the air outlet 101, at least some air enters the passages above and below the air outlet 101 after the air is dispersed by the second air deflector 112.

When the passage is arranged above the air outlet 101 (or is arranged below but closed), at least some air enters the passages above the air outlet 101 after the air is dispersed by the second air deflector 112, and the remaining air flows out from the air outlet 101.

When the passage is arranged below the air outlet 101 (or is arranged above but closed), at least some air enters the passages below the air outlet 101 after the air is dispersed by the second air deflector 112, and the remaining air flows out from the air outlet 101.

When the passages are not arranged above and below the air outlet 101 (or are arranged above and below but closed), the second air deflector 112 extending along the outlet direction does not prevent airflow.

The second air deflector 112 directs air upwardly at the second position thereof.

For example, the airflow from the air outlet 101 will be directed upwardly. While the air conditioner 100 is in cooling mode, the second air deflector 112 directs air upwardly, and the cold air settles subsequently, producing a spray-like airflow effect. In this case, the cooling effect is better. It is also applicable to heating mode.

Further, the second air deflector 112 inclines upwardly along the air outflow direction of the air outlet 101 at the second position, so as to achieve better effect in directing airflow upwardly.

Advantageously, the second air deflector 112 lies in front of the air outlet 101 at the second position, and at least partially or all lies in the air outlet 101. For example, the second air deflector 112 faces the middle position along the width of the air outlet 101.

The second air deflector 112 directs air downwardly at the third position thereof.

For example, the air conditioner 100 can supply air downwardly. While the air conditioner 100 is in heating mode, the second air deflector 112 rotates or pivots to direct air downwardly. Due to the movement of rising heat air, the heat air directed downwardly can fill the whole space easily, which improves the comfort of heating.

In addition, directing air downwardly can warm feet. It is also applicable to cooling. Further, the second air deflector 112 inclines downwardly and extends along the air outflow direction of the air outlet 101 at the third position.

The second air deflector 112 obstructs the air outlet 101 at the fourth position thereof. In other words, the second air deflector 112 is substantially perpendicular to the direction of the air outlet 101 at the fourth position (i.e., perpendicular to the outlet direction, forming an angle of 50 to 90 degrees with the outlet direction).

In addition, the second air deflector 112 can be spaced with the top and bottom of the air outlet 101 at the fourth position, and air can flow out from the top and bottom of the second air deflector 112.

For example, the second air deflector 112 is provided with an air diffusing structure, which can be the air diffusing structure mentioned above.

In addition, the passages can be arranged above and below the air outlet 101. The embodiments are described below by reference to the attached drawings based on any one embodiment.

Embodiment 1

As shown in FIGS. 1-7, the upper passage 102 is arranged above the air outlet 101, which connects the air outlet 101 and can supply air forwardly. The upper air deflection assembly 12 is arranged to match the upper passage 102. In other words, the air conditioner 100 in the present disclosure also comprises the upper air deflection assembly 12, used to direct air to flow from the terminus of the upper passage 102.

Considering the previous description, when the front air deflection assembly 11 comprises the first air deflector 111, the first air deflector 111 and the front external contour of the main body 1 in the air outflow direction of the outlet passage 102 can be completely staggered, so as to avoid preventing the airflow from the upper passage 102.

Figure 3:
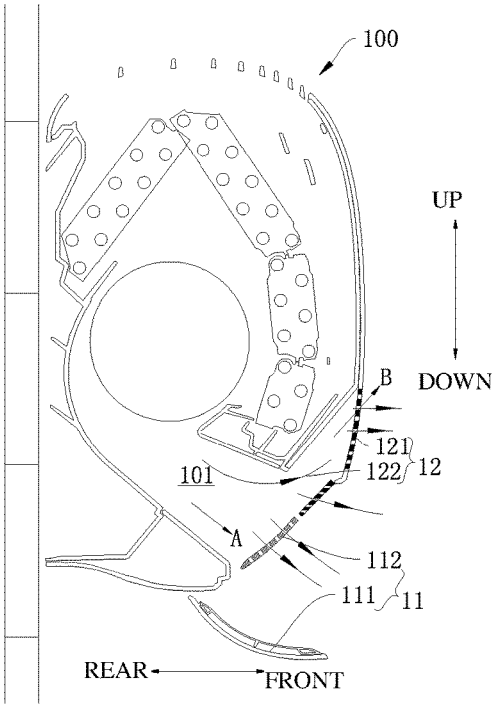

As shown in FIG. 3, in some examples of the present disclosure, the upper air deflection assembly 12 comprises the upper air diffusing plate 121, which can close the upper passage 102.

Further, as shown in FIG. 3, the air diffusing structure is arranged on the upper air diffusing plate 121, which can be the air diffusing structure mentioned above.

For example, the upper air diffusing plate 121 is arranged at the terminus of the upper passage 102.

Figure 2:
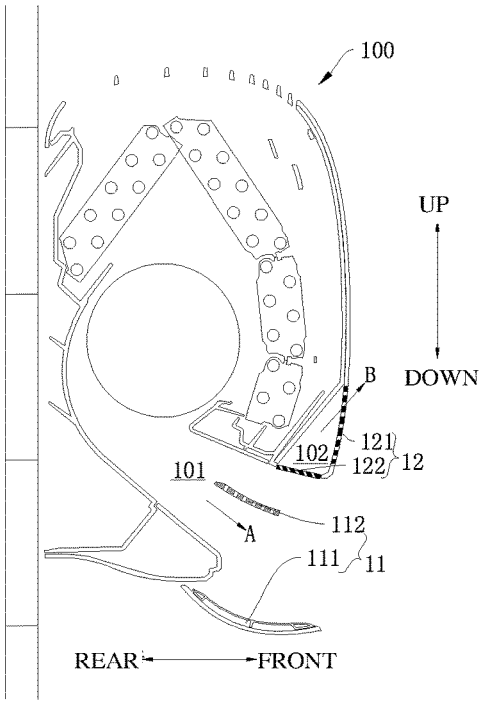

As shown in FIGS. 2 and 3, in some examples of the present disclosure, the upper air deflection assembly 12 also comprises an upper spoiler 122, which can move between the positions of opening and closing the upper passage 102.

For example, when the upper spoiler 122 opens the upper passage 102, the upper spoiler 122 extends toward the inside of the air outlet 101 and directs at least some air from the air outlet 101 to the upper passage 102.

For example, when the upper spoiler 122 opens the upper passage 102, it can face the middle of the upper passage 102, and can also lie at the backward position of the upper passage 102 in the air outflow direction of the air outlet 101.

When the upper spoiler 122 is open, it can be substantially perpendicular to the air outflow direction of the air outlet 101, and can also incline along the air outflow direction of air outlet 101 to the upper passage.

Further, the upper spoiler 122 can be rotationally mounted at an entry of the upper passage 102.

For example, the air diffusing structure is arranged on the upper spoiler 122. When the upper spoiler 122 closes the upper passage 102, partial air of the air outlet 101 can flow out from the upper passage 102 through the upper spoiler 122. When the upper spoiler 122 opens the upper passage 102, some air of the air outlet 101 passing through the upper spoiler 122 flows out from the air diffusing structure of the upper spoiler 122, and the remaining air is guided to flow out from the upper passage 102.

In addition, the air diffusing structure on the upper spoiler 122 can be the air diffusing structure mentioned above.

In the embodiments, when the front air deflection assembly 11 comprises the second air deflector 112, the second air deflector 112 can coordinate with the upper spoiler 122 to supply air.

For instance, when the upper spoiler 122 opens the upper passage 102, the upper spoiler 122 and the second air deflector 112 can both be substantially perpendicular to the air outflow direction of the air outlet 101; or the upper spoiler 122 is substantially perpendicular to the air outflow direction of the air outlet 101, while the second air deflector 112 lies along the air outflow direction of the air outlet 101.

In addition, the heat insulating member 14 can be mounted inside the upper passage 102.

Embodiment 2

Different from Embodiment 1, the upper passage 102 can be open and closed.

Figure 4:
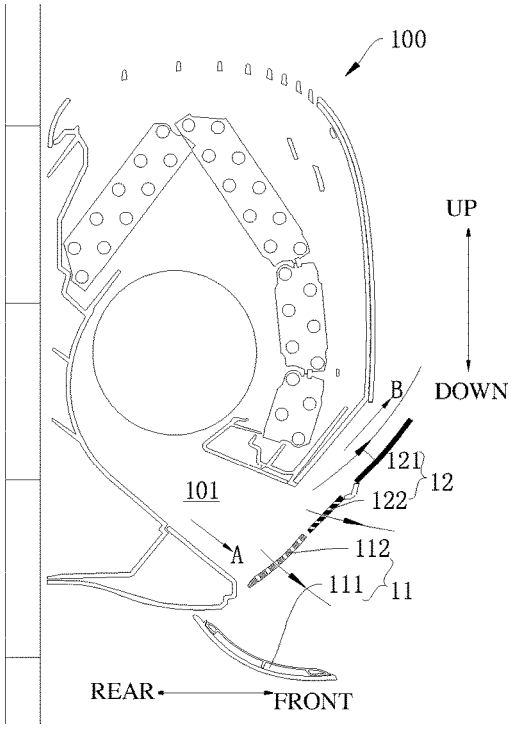

For example, as shown in FIGS. 3 and 4, the upper air deflection assembly 12 at the upper passage 102 comprises the upper air diffusing plate 121, which can open and close the upper passage 102.

When the upper air diffusing plate 121 is open, it can guide the air of the upper passage 102. For example, when the upper air diffusing plate 121 is open, it can extend toward the outside of the air conditioner and incline upwardly.

In addition, the upper air diffusing plate 121 can be arranged at the terminus of the upper passage 102, and can open and close the upper passage 102 by rotation or pivotal movement.

Figure 5:
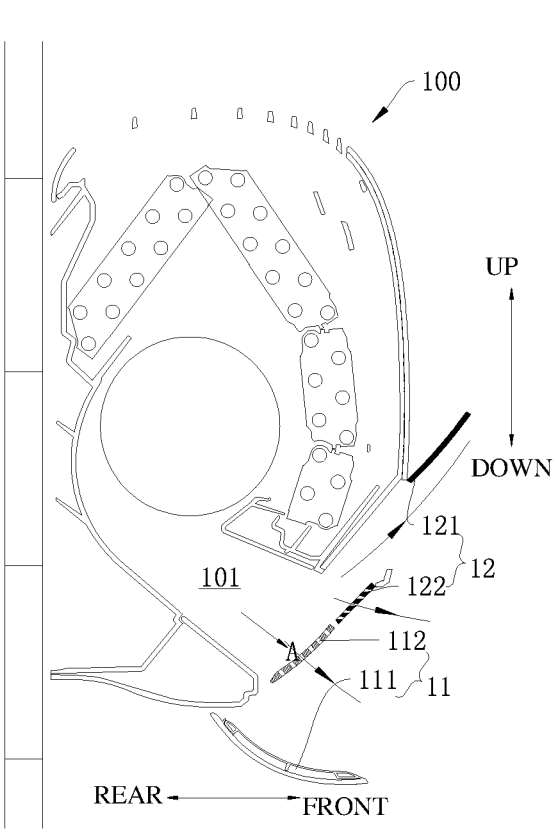
Figure 6:
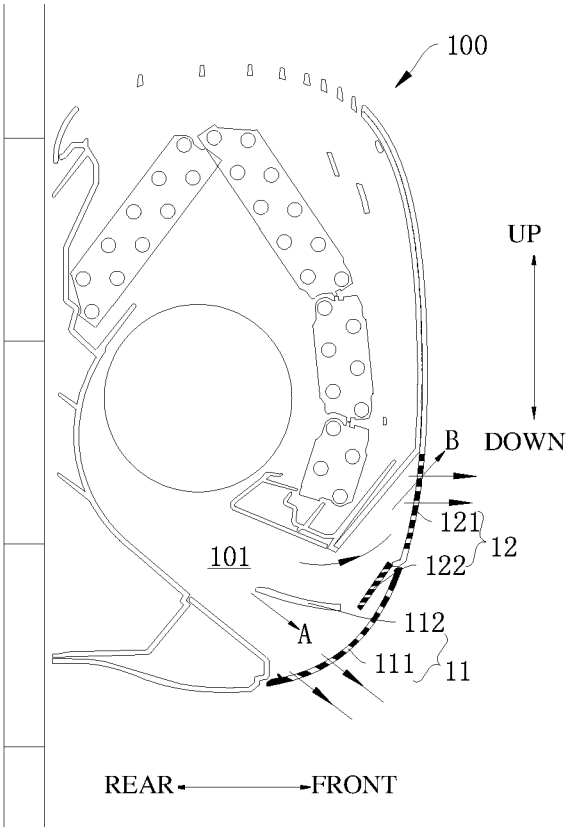
Figure 7:
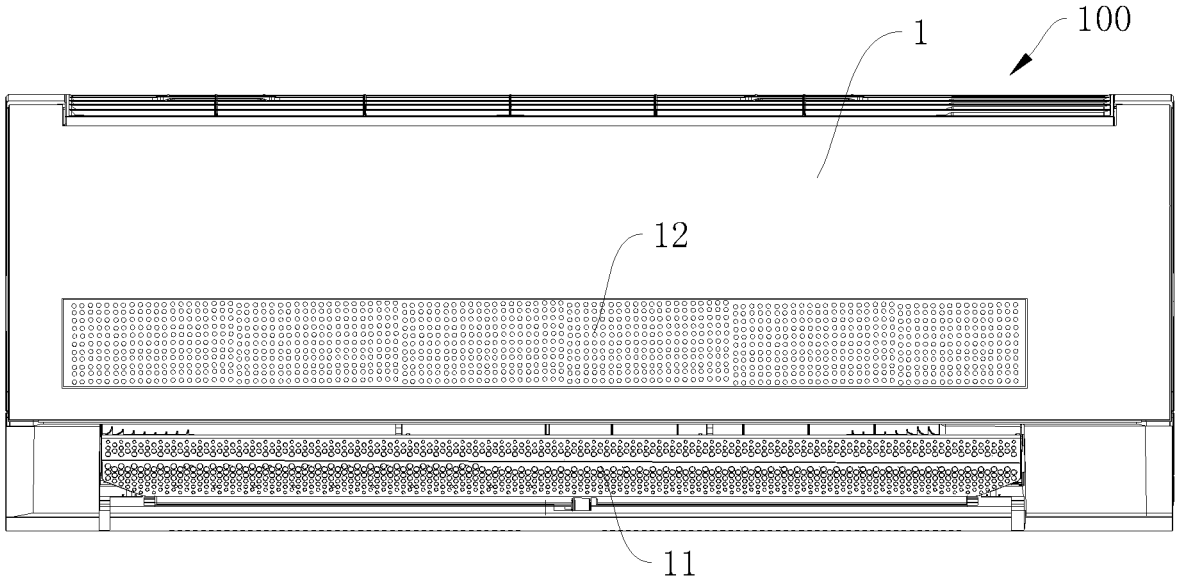

For instance, as shown in FIG. 4, the upper end of the upper air diffusing plate 121 can be set as the rotating or pivoting end. In other words, the upper end of the upper air diffusing plate 121 can rotate or pivot. When the upper air diffusing plate 121 is open, air flows out below the upper air diffusing plate 121. As shown in FIG. 5, the lower end of the upper air diffusing plate 121 can serve as the rotating or pivoting end. In other words, the lower end of the upper air diffusing plate 121 can rotate or pivot. When the upper air diffusing plate 121 is open, air flows out above the upper air diffusing plate 121.

The upper spoiler 122 of Embodiment 1 can also be optionally provided.

The structure of the upper air diffusing plate 121 can be similar to or same as that in Embodiment 1. In other words, the upper air diffusing plate 121 in Embodiment 2 can be provided with the air diffusing structure.

Within the scope of the disclosure, the various structures and configurations of the first embodiment as previous articulated can be equitably applied to and/or combined with the second embodiment. Thus, the omission of description of any above structures and configurations of the previous embodiment(s) should not be construed as limiting or a waiver of these structures and configurations in the current embodiment.

Embodiment 3

As shown in FIGS. 8-12, the lower passage 103 is arranged below the air outlet 101, which connects the air outlet 101 and can supply air backwardly. The lower air deflection assembly 13 is arranged to match the lower passage 103. In other words, the air conditioner 100 in the present disclosure also comprises the lower air deflection assembly 13, used to direct air to flow from the terminus of the lower passage 103.

Considering the above embodiments, when the front air deflection assembly 11 comprises the first air deflector 111, the first air deflector 111 and the front in the air outflow direction of the lower passage 103 can be completely staggered, so as to avoid preventing the airflow from the lower passage 103.

As figures shown, in some examples of the present disclosure, the lower air deflection assembly 13 comprises the lower air diffusing plate 131, which can close the lower passage 103.

Further, the air diffusing structure is arranged under the lower air diffusing plate 131, which can be the air diffusing structure mentioned above.

For example, the lower air diffusing plate 131 is arranged at the terminus of the lower passage 103.

In some examples of the present disclosure, the lower air deflection assembly 13 also comprises lower spoiler 132, which can move between the positions of opening and closing the lower passage 103.

For example, when the lower spoiler 132 opens the lower passage 103, the lower spoiler 132 extends toward the inside of the air outlet 101 and directs at least some air from the air outlet 101 to the lower passage 103.

For example, when the lower spoiler 132 opens the lower passage 103, it can face the middle of the lower passage 103, and can also lie at the backward position of the lower passage 103 in the air outflow direction of the air outlet 101.

When the lower spoiler 132 is open, it can be substantially perpendicular to the air outflow direction of the air outlet 101, and can also incline along the air outflow direction of air outlet 101 to the lower passage 103.

Further, the lower spoiler 132 can be rotationally mounted at an entry of the lower passage 103.

For example, the air diffusing structure is arranged under the lower spoiler 132. When the lower spoiler 132 closes the lower passage 103, partial air of the air outlet 101 can flow out from the lower passage 103 through the lower spoiler 132. When the lower spoiler 132 opens the lower passage 103, some air of the air outlet 101 passing through the lower spoiler 132 flows out from the air diffusing structure of the lower spoiler 132, and the remaining air is directed to flow out from the lower passage 103.

In addition, the air diffusing structure under the lower spoiler 132 can be the air diffusing structure mentioned above.

In the embodiments, when the front air deflection assembly 11 comprises the second air deflector 112, the second air deflector 112 can combine with the lower spoiler 132 to supply air.

For instance, when the lower spoiler 132 opens the lower passage 103, the lower spoiler 132 and the second air deflector 112 can both be substantially perpendicular to the air outflow direction of the air outlet 101; or the lower spoiler 132 substantially perpendicular to the air outflow direction of the air outlet 101, while the second air deflector 112 lies along the air outflow direction of the air outlet 101.

In addition, the heat insulating member 14 can be mounted inside the lower passage 103.

Within the scope of the disclosure, the various structures and configurations of the first and second embodiments as previous articulated can be equitably applied to and/or combined with the third embodiment. Thus, the omission of description of any above structures and configurations of the previous embodiment(s) should not be construed as limiting or a waiver of these structures and configurations in the current embodiment.

Embodiment 4

As shown in FIGS. 8-12, different from Embodiment 3, the lower passage 103 can be open and closed.

For example, the lower air deflection assembly 13 at the lower passage 103 comprises the lower air diffusing plate 131, which can open and close the lower passage 103.

When the lower air diffusing plate 131 is open, it can guide the air of the lower passage 103. For example, when the lower air diffusing plate 131 is open, it can extend toward the outside of the air conditioner and incline upwardly.

In addition, the lower air diffusing plate 131 can be arranged at the terminus of the lower passage 103, and can open and close the lower passage 103 by rotation or pivotal movement.

Figure 11:
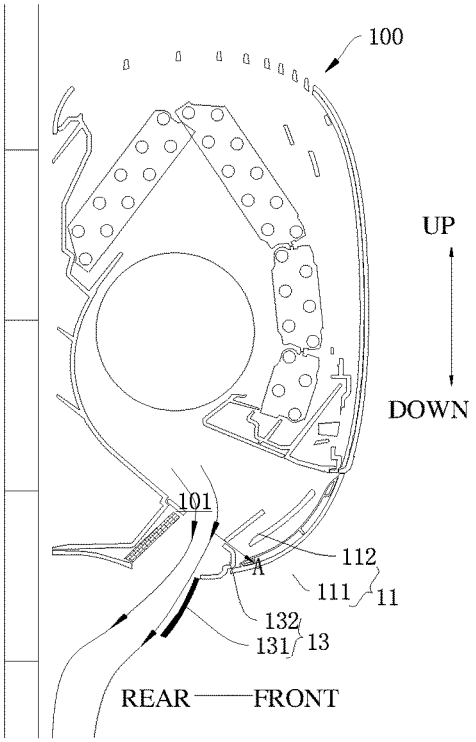
Figure 12:
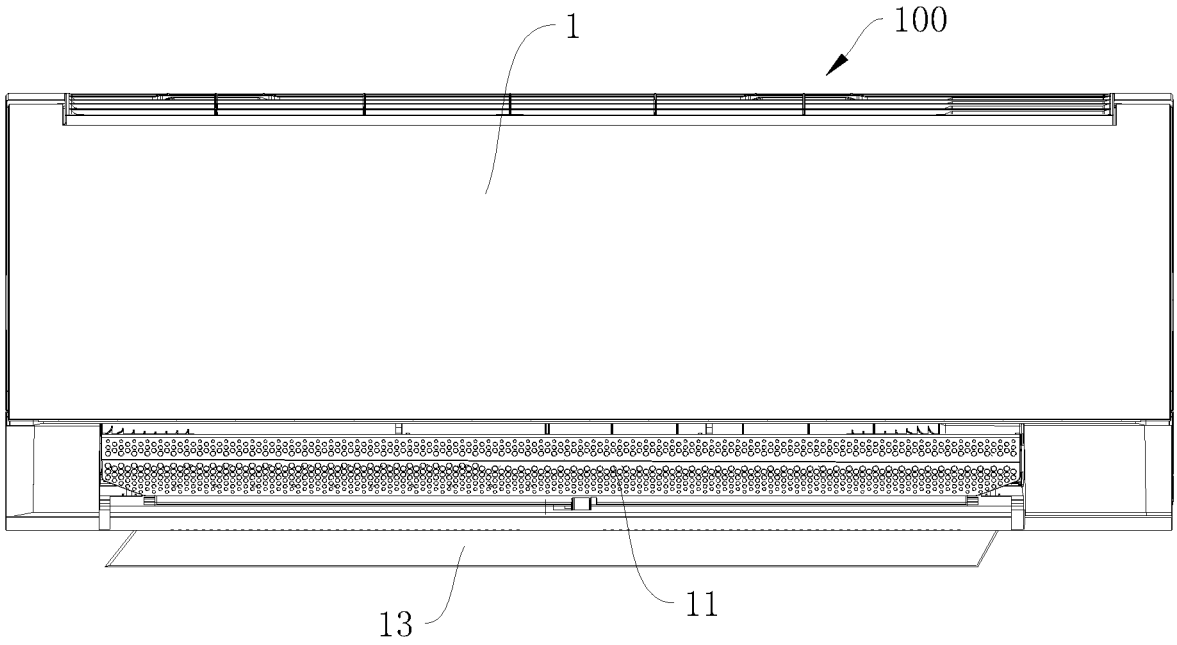
Figure 13:
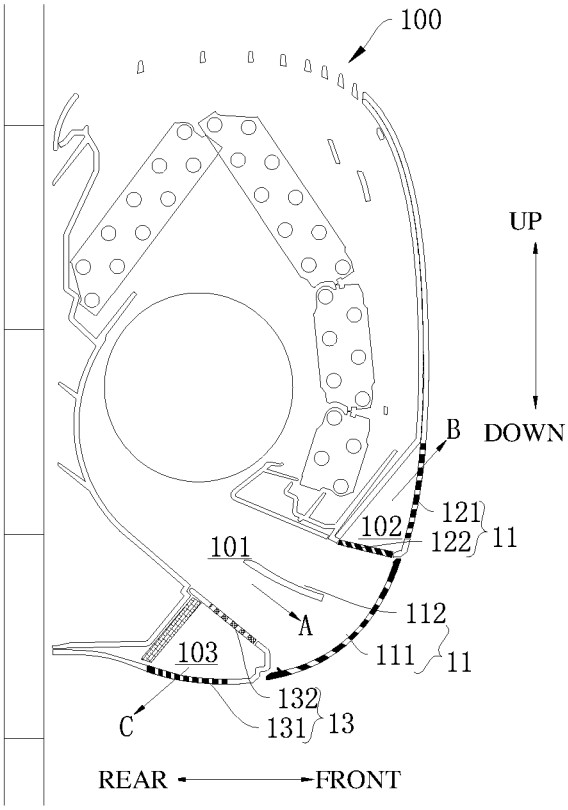
FIGS. 13-22 are schematic views of an air conditioner at different operational states thereof, in accordance with still another exemplary embodiment of the present disclosure.
Figure 14:
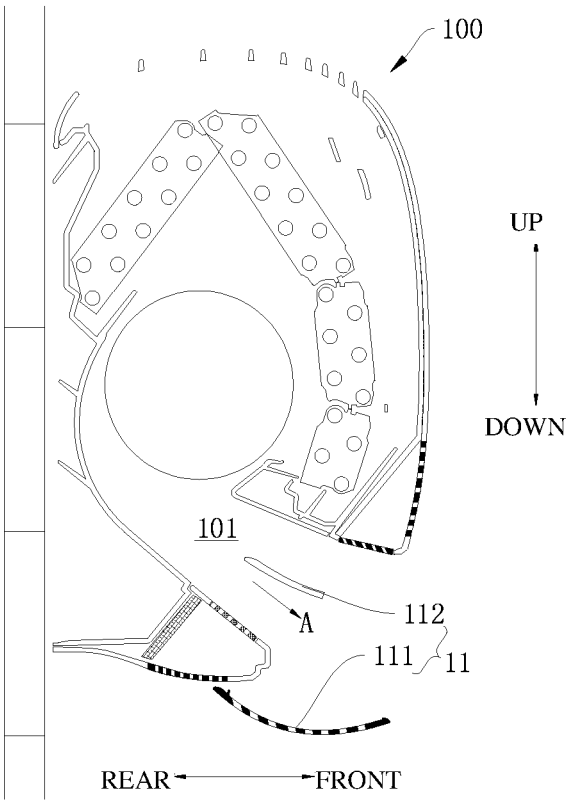

For instance, as shown in FIG. 11, the rear end of the lower air diffusing plate 131 can serve as the rotating end or pivoting end. In other words, the rear end of the lower air diffusing plate 131 can rotate or pivot. Alternatively, the front end of the lower air diffusing plate 131 can be set as the rotating end or pivoting end; and in other words, the front end of the lower air diffusing plate 131 can rotate or pivot. When the lower air diffusing plate 131 is open, air flows out in front of the lower air diffusing plate 131.

The lower spoiler 132 in Embodiment 1 can be optionally provided.

The structure of the lower air diffusing plate 131 can be similar to or same as that in Embodiment 1. In other words, the lower air diffusing plate 131 in Embodiment 2 can be provided with the air diffusing structure.

Within the scope of the disclosure, the various structures and configurations of the first to third embodiments as previous articulated can be equitably applied to and/or combined with the third embodiment. Thus, the omission of description of any above structures and configurations of the previous embodiment(s) should not be construed as limiting or a waiver of these structures and configurations in the current embodiment.

Embodiment 5

As shown in FIGS. 13-22, different from the above embodiments, the upper passage 102 is arranged above the air outlet 101, which connects the air outlet 101 and can supply air forwardly. The lower passage 103 is arranged below the air outlet 101, which connects the air outlet 101 and can supply air backwardly. Moreover, the upper air deflection assembly 12 can be arranged at the upper passage 102, and the lower air deflection assembly 13 can be arranged at the lower passage 103.

In addition, it can comprise partial or all technical proposals in Embodiment 1 and Embodiment 2. It can also comprise partial or all technical proposals in Embodiment 3 and Embodiment 4.

Within the scope of the disclosure, the various structures and configurations of the first to fourth embodiments as previous articulated can be equitably applied to and/or combined with the third embodiment. Thus, the omission of description of any above structures and configurations of the previous embodiment(s) should not be construed as limiting or a waiver of these structures and configurations in the current embodiment.

For the air conditioner 100 based on different embodiments of the present disclosure, air can flow backwardly against the wall and/or forwardly. It is breezeless but offers larger wind volume, and keeps beautiful classical "holes". In addition, it can avoid the backflow caused by low wind speed during the breezeless blow in positive direction, and the breezeless blow in negative direction preforms better.

In the description of the present disclosure, the terms "an embodiment", "some embodiments", "example", "specific example", or "some examples" etc. mean that the specific feature, structure, material or characteristic of that embodiment or example described are comprised in at least one embodiment or example of the present disclosure. In this description, the schematic presentation of such terms may not refer to the same embodiment or example. Moreover, the specific features, structure, material or characteristics described may be combined in an appropriate manner in any one or multiple embodiments or examples. In addition, common technicians can combine and integrate the features in any one or multiple embodiment or examples, if no contradiction exists.

Although the embodiments of the present disclosure have been presented and described, it is understandable that the embodiments described above are illustrative and should not be construed as restrictions on the present disclosure. Changes, modifications, substitutions and variations of such embodiments can be made by common technicians in the field.

What is claimed is:

1. An air conditioner comprising:

a main body having a front side and a rear side, wherein the air conditioner is mountable to a support through the rear side of the main body, wherein the front side is distanced from the rear side and opposite to the rear side, wherein the main body comprises an air outlet facing a front lower side, wherein an upper passage in communication with the air outlet is arranged above the air outlet and is adapted to supply air forwardly;

an upper air deflection assembly used to direct air to flow out of a terminus of the upper passage, and comprising an upper air diffusing plate used to open and close the upper passage, wherein the upper air deflection assembly comprises an upper spoiler movable between a position opening the upper passage and a position closing the upper passage, wherein the upper spoiler is located upstream of the upper air diffusing plate; and a front air deflection assembly used to direct air to flow out of a terminus of the air outlet, the front air deflection assembly comprising a first air deflector located at an opening of the air outlet and adapted to open and close the air outlet, and the front air deflection assembly comprising an air diffusing structure.

2. The air conditioner according to claim 1, wherein the upper air diffusing plate is arranged at the terminus of the upper passage, and an upper end or a lower end of the upper air diffusing plate is a rotating end.

3. The air conditioner according to claim 2, wherein the upper air diffusing plate has an air diffusing structure.

4. The air conditioner according to claim 1, wherein the upper spoiler extends toward an interior of the air outlet and is adapted to direct at least part of airflow from the air outlet to the upper passage, when the upper spoiler opens the upper passage.

5. The air conditioner according to claim 4, wherein the upper spoiler is substantially perpendicular to the air outflow direction of the air outlet, when the upper spoiler is open.

6. The air conditioner according to claim 1, wherein the upper spoiler is rotatably mounted at an entry of the upper passage.

7. The air conditioner according to claim 6, wherein the upper spoiler is provided with an air diffusing structure.

8. The air conditioner according to claim 1, wherein a thermal insulation member for the upper passage is provided adjacent to a side wall of the upper passage.

9. The air conditioner according to claim 1, wherein an outer surface of the first air deflector is substantially flush with an outer surface of the main body, when the first air deflector closes the air outlet.

10. The air conditioner according to claim 1, wherein the first air deflector is connected with the main body and is flappable upwardly and downwardly, and when the first air deflector opens the air outlet, the first air deflector is adapted to:

be completely offset from a front side of an air outflow direction of the air outlet;

be completely offset from a front side of an air outflow direction of an outlet passage; or have at least a part located in front of the air outflow direction of the air outlet, and direct air upwardly or downwardly.

11. An air conditioner comprising:

a main body having a front side and a rear side, wherein the air conditioner is mountable to a support through the rear side of the main body, wherein the front side is distanced from the rear side and opposite to the rear side, wherein the main body comprises an air outlet facing a front lower side, wherein an upper passage in communication with the air outlet is arranged above the air outlet and is adapted to supply air forwardly;

an upper air deflection assembly used to direct air to flow out of a terminus of the upper passage, and comprising an upper air diffusing plate used to open and close the upper passage; and a front air deflection assembly used to direct air to flow out of a terminus of the air outlet, the front air deflection assembly comprising:

a first air deflector located at an opening of the air outlet and adapted to open and close the air outlet;

an air diffusing structure; and a second air deflector located at an opening of the air outlet, wherein the second air deflector has a first position at which the second deflector extends along the air outflow direction of the air outlet to provide an air diffusing effect.

12. The air conditioner according to claim 11, wherein the second air deflector is provided with an air diffusing structure.

13. The air conditioner according to claim 11, wherein the second air deflector further has:

a second position at which the second air deflector is inclined upwardly along the air outflow direction of the air outlet, a third position at which the second air deflector is inclined downwardly along the air outflow direction of the air outlet, and a fourth position at which the second air deflector is substantially perpendicular to the air outflow direction of the air outlet.

* * * * *